US006543432B2

(12) United States Patent
Andrews et al.

(10) Patent No.: US 6,543,432 B2
(45) Date of Patent: Apr. 8, 2003

(54) ARCHERY BOW VIBRATION DAMPENING SYSTEM

(75) Inventors: Albert A. Andrews, Cleveland, TN (US); Spencer D. Land, Dunlap, TN (US)

(73) Assignee: Spenco, Dunlap, TN (US)

( * ) Notice: Subject to any disclaimer, the term of this patent is extended or adjusted under 35 U.S.C. 154(b) by 0 days.

(21) Appl. No.: 09/746,483

(22) Filed: Dec. 21, 2000

(65) Prior Publication Data

US 2002/0078939 A1 Jun. 27, 2002

(51) Int. Cl.[7] ..... F41B 5/00
(52) U.S. Cl. ..... 124/23.1; 124/25.6
(58) Field of Search ..... 124/23.1, 25.6, 124/86, 88, 89

(56) References Cited

U.S. PATENT DOCUMENTS

| | | | | |
|---|---|---|---|---|
| 4,080,951 A | | 3/1978 | Bateman, III | |
| 4,457,287 A | | 7/1984 | Babington | |
| 4,570,608 A | | 2/1986 | Masterfield | |
| 5,388,563 A | | 2/1995 | Hsu | |
| 5,433,792 A | * | 7/1995 | Darlington | 124/25.6 |
| 5,452,704 A | | 9/1995 | Winebarger | |
| 5,507,270 A | * | 4/1996 | Smith | 124/23.1 |
| 5,553,596 A | | 9/1996 | Bednar | |
| 5,595,168 A | | 1/1997 | Martin | |
| 5,720,267 A | * | 2/1998 | Walk | 124/23.1 |
| 5,720,269 A | | 2/1998 | Saunders | |
| 5,772,541 A | | 6/1998 | Buiatti | |
| 6,360,734 B1 | * | 3/2002 | Andrews | 124/23.1 |

* cited by examiner

*Primary Examiner*—John A. Ricci
(74) *Attorney, Agent, or Firm*—Reising, Ethington, Barnes, Kisselle, Learman & McCulloch, P.C.

(57) ABSTRACT

An archery bow has at least one dampener to reduce noise and vibration of the bow in use. Desirably, at least one dampener, and preferably a plurality of individual dampeners may be disposed in the area of the connection of a limb to a riser or handle portion of the bow to reduce vibrations transferred to the riser by the limb. Additionally, the archery bow preferably has a cam adapted to receive a dampener to reduce the noise and vibration passing between the cam and the limb. Any number of dampeners may be used in combination, or the dampeners may be used separately as desired.

30 Claims, 4 Drawing Sheets

ARCHERY BOW VIBRATION DAMPENING SYSTEM

FIELD OF THE INVENTION

This invention relates generally to archery bows and more specifically to an archery bow with one or more vibration dampeners.

BACKGROUND OF THE INVENTION

Noise and vibrations in an archery bow cause the user several problems. For example, while hunting, noise and vibration of the bow can scare an animal away reducing the opportunities to shoot the animal, or at the very least can cause the animal to move before the arrow strikes the intended target. Additionally, increased vibrations in a bow can indicate a less efficient bow producing reduced power and a slower speed of an arrow shot from the bow. Vibrations also make it more difficult for the user to acquire a good feel for the bow, and make it more difficult for the user to achieve consistent and accurate shots. In addition, the vibrations make it uncomfortable for the user to sustain use of the bow for prolonged periods. Finally, vibrations can damage or weaken the bow reducing its useful life.

Attempts have been made to quiet archery bows. String silencers in the form of rubber or yam strands have been attached to the bow strings or cables, as shown in U.S. Pat. No. 4,080,951. Also, U.S. Pat. No. 4,570,608 (the '608 patent), discloses a stabilizer attached to a riser portion of the bow to reduce vibration. The stabilizer disclosed in the '608 patent is threaded into a bore in the riser and therefore creates an additional source for vibration, requires costly machining of threads in the riser, and is bulky. Nevertheless, these efforts have removed only some of the noise and vibration from the archery bows. In addition, U.S. Pat. No. 5,553,596 shows a cross bow with a bushing extending along the length of a mounting channel in a limb socket. The mounting channel of the limb socket extends over a portion of a riser block assembly and the limb socket pivots in relation to the riser block assembly. When the limb socket is pivoted relative to the riser block assembly, the bushing does not fully engage the riser block assembly reducing the effectiveness of the bushing.

SUMMARY OF THE INVENTION

An archery bow has at least one dampener to reduce noise and vibration of the bow in use. Desirably, at least one dampener, and preferably a plurality of individual dampeners may be disposed in the area of the connection of a limb to a riser or handle portion of the bow to reduce vibrations transferred to the riser by the limb. Additionally, the archery bow preferably has a cam adapted to receive a dampener to reduce the noise and vibration passing between the cam and the limb. Any number of dampeners may be used in combination, or the dampeners may be used separately as desired.

Each dampener is strategically positioned and arranged to limit vibrations in the cam, limb and riser. The dampeners disposed generally in the area of attachment of the limb to the riser can be placed between a pocket body which receives the limb and the riser which carries the pocket body, and/or between the limb and the pocket body to reduce noise and vibration from passing between the pocket body, the riser and the limb. One or more dampeners can be placed between the pocket body and the limb to reduce the transfer of noise and vibration between the limb and pocket body and thereby lessen the noise and vibration transferred to the riser and then to the user. A dampener can also be disposed around a limb bolt used for attaching the limb to the riser such that the dampener is between a head of the limb bolt and the limb. This dampener reduces noise and vibration between the limb bolt, the limb, and the riser. A dampener can also be disposed around the limb bolt such that it engages the limb and the riser to reduce the transfer of noise and vibration between the limb and the riser, and ultimately to the user.

A dampener carried by the cam can be adhered to the cam, or it can be received in an opening through the cam. The dampener carried by the cam reduces noise and vibration between the cam and the limb and thus reduces the noise and vibration that the user experiences.

Objects, features and advantages of this invention include providing one or more dampeners for an archery bow where the dampeners can be used separately or in combination with each other to reduce noise and vibration in cams, idler wheels, limbs, pocket bodies and/or riser of the archery bow. The reduction in noise and vibration helps to prevent scaring away hunted animals, allows the user to practice shooting for prolonged periods of time, and provides the user an opportunity to achieve optimal shooting accuracy and arrow velocity. Dampeners extend the useful life of limbs, bolts, strings, cam and idler pulley bearings, axles and the bow in general. The dampeners are of relatively simple design and economical manufacture and assembly and have a long and useful life in service.

BRIEF DESCRIPTION OF THE DRAWINGS

These and other objects, features and advantages of this invention will be apparent from the following detailed description of the preferred embodiments and best mode, appended claims, and accompanying drawings in which:

DETAILED DESCRIPTION OF THE PREFERRED EMBODIMENTS

Figure 1:
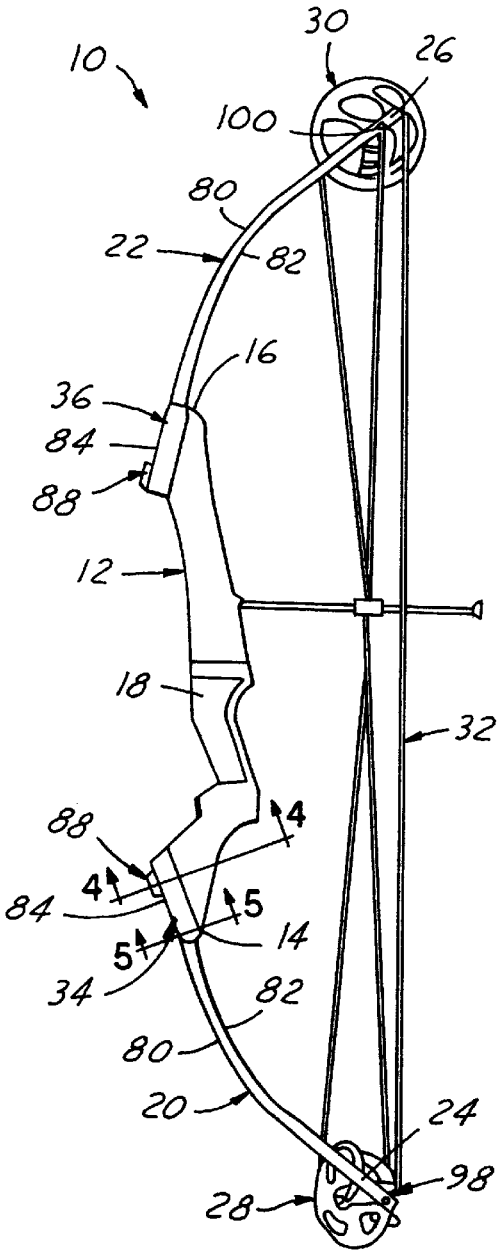
FIG. 1 is a side view of an archery bow having a plurality of dampeners in accordance with the present invention.

Referring in more detail to the drawings, FIG. 1 illustrates an archery bow 10 having at least one dampener to reduce noise and vibration of the archery bow 10 in use. The archery bow 10 has a riser 12 with opposed ends 14, 16, a handle portion 18 between the ends 14, 16, and a pair of limbs 20, 22 each connected to a separate one of the ends 14, 16 of the riser 12 and having opposed free ends 24, 26 spaced from the riser 12. A cam 28 is carried by one limb 20 adjacent its free end 24, an idler wheel 30 is carried by the other limb 22 adjacent its free end 26 and a bow string 32 is trained around both the cam 28 and the idler wheel 30. The bow string 32, having an arrow disposed thereon, is drawn away from the riser 12 to store energy in the limbs 20, 22 and released to propel the arrow towards a target. At least one, and preferably more than one dampener is disposed generally in the area of attachment of the limbs 20, 22 to the riser 12. A dampener is preferably also carried by the cam 28 and/or the idler wheel 30. The dampeners may comprise a wide variety of shapes and materials to be disposed as desired on the various components of the archery bow 10 to reduce noise and vibration in the bow.

Figure 2:
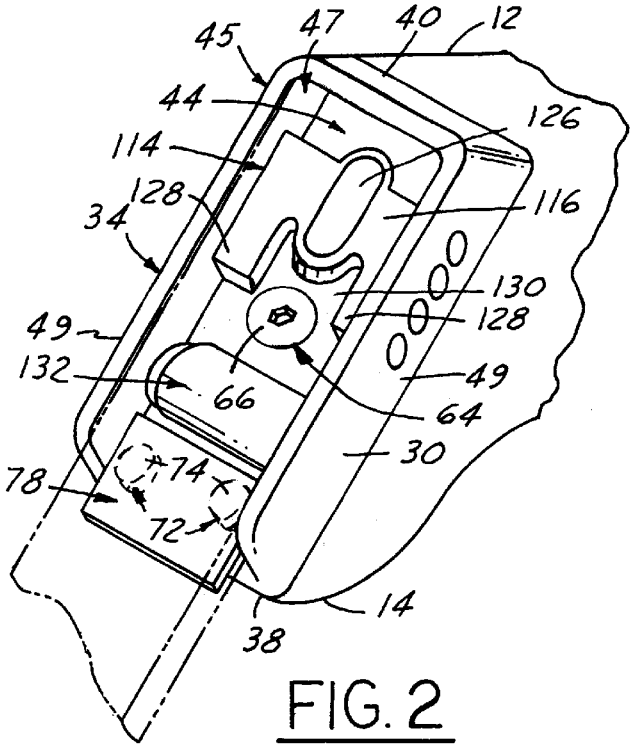
FIG. 2 is a fragmentary perspective view of a pocket body and riser of the archery bow of FIG. 1 illustrating dampeners, a pivot plate, and pivot pins disposed in the pocket body.
Figure 3:
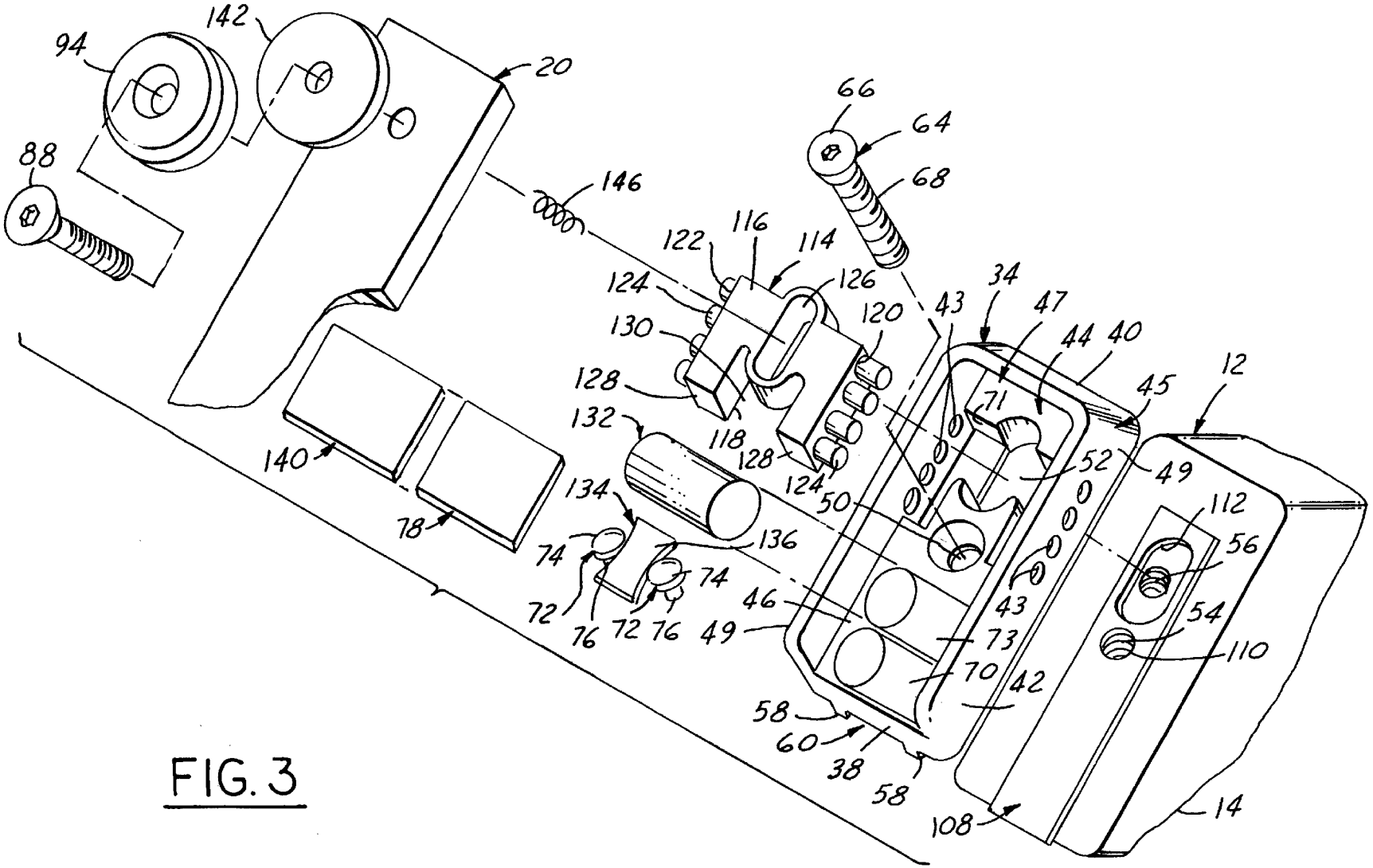
FIG. 3 is a an exploded view showing the components generally in the area of attachment of a limb and pocket body to a riser.
Figure 4:
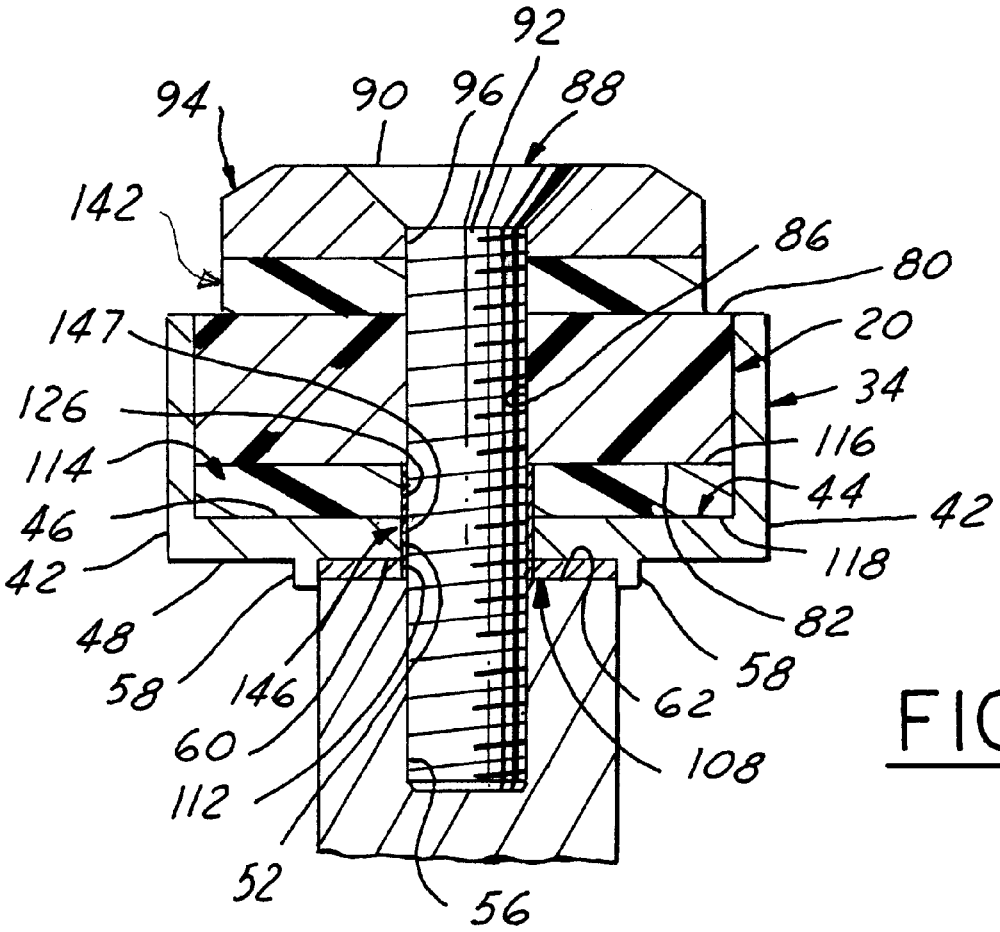
FIG. 4 is a cross-sectional view taken along line 4—4 of FIG. 1.
Figure 5:
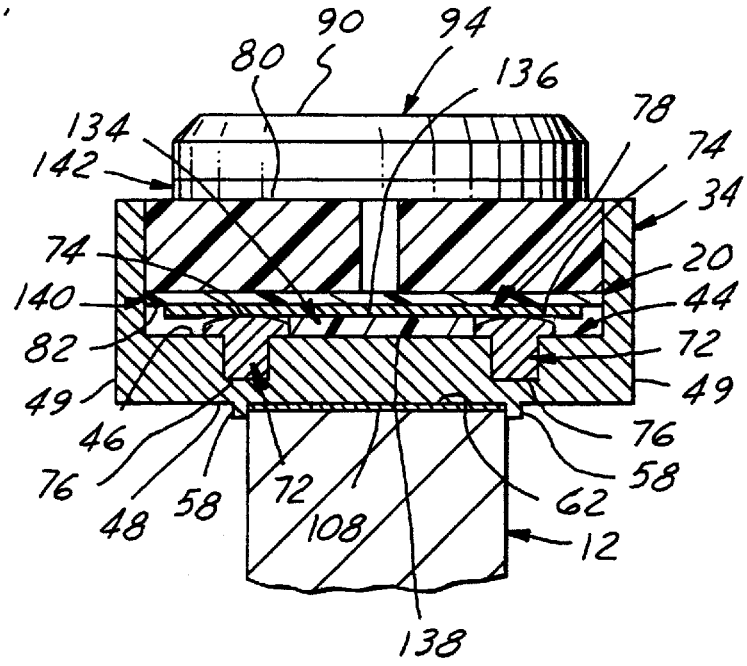
FIG. 5 is a cross-sectional view taken along line 5—5 of FIG. 1.

To facilitate attaching the limbs 20, 22 to the riser 12, a separate pocket body 34, 36 is attached on each end 14, 16, respectively, of the riser 12. Since both pocket bodies 34, 36 are preferably identical, only one pocket body 34 and its associated components will be discussed below, unless specifically stated otherwise. As shown in FIGS. 2 and 3, the pocket body 34 has a base 44 and a U-shaped wall 45 extending upwardly from the base 44 to define a cavity 47 open at one end 38 to receive the bow limb 20. The wall 45 has sidewalls 49 and a transverse rear wall 51 interconnecting the sidewalls 49. A plurality of holes 43 taking on substantially any shape such as circular, square, rectangular, or the like are preferably formed through the sidewalls 49, but may be formed in any other surface of the pocket body 34. The base 44 of the pocket body 34 has an upper surface 46 and a lower surface 48, as shown in FIGS. 4 and 5, with a counter sunk hole 50 and a slot 52 passing through the base 44 in alignment with a first threaded hole 54 and a second threaded hole 56 in the riser 12, respectively. The lower surface 48 of the pocket body 34 preferably has a pair of generally parallel ribs 58 extending between the opposed ends 38, 40 of the pocket body 34 defining a channel 60 between the ribs 58. The channel 60 is aligned with a mounting face 62 on an end 14 of the riser 12 and the ribs 58 prevent skewing or rotation of the pocket body 34 on the riser 12. A pocket bolt 64 has a head 66 and a threaded shank 68 which is inserted through hole 50 of the pocket body 34 and threaded into the first threaded hole 54 in the riser 12 so that the head 66 of the pocket bolt 64 is generally flush with the upper surface 46 of the base 44 of the pocket body 34 to retain the pocket body 34 on the riser 12. The pocket body 34 may be formed from metal, polymer or a composite material.

Preferably, the pocket body 34 has first, second, and third recesses 70, 71, 73 formed in the upper surface 46 of its base 44. A pair of pivot pins 72 each having a generally spherical head 74 and a shaft or shank 76 extending from the head 74 are received in the first recess 70 such that the head 74 of the pivot pins 72 extend outwardly from the first recess 70. A pivot plate 78 is received between the limb 20 and the pivot pins 72 to provide a controlled pivot, bend or flex point for the limb 20.

The bow 10 has two limbs 20, 22, but only the limb 20 is discussed here due to their similarity, unless specifically stated otherwise. The limb 20 has an upper surface 80, a lower surface 82 and a first end 84 having a through hole 86 which receives a limb bolt 88 to connect the limb 20 to the pocket body 34 and the riser 12. The limb bolt 88 has an enlarged head 90 at one end and a threaded shank 92 extending from the head 90. A first washer 94 having a through hole 96 is disposed on the shank 92 prior to inserting the limb bolt 88 into the through hole 86 in the limb 20. In assembly, the shank 92 of the limb bolt 88, with the first washer 94 disposed thereon, is inserted into the through hole 86 of the limb 20, through the slot 52 in the pocket body 34 and is threaded into the second threaded hole 56 in the riser 12 to attach the limb 20 to the riser 12 such that the limb 20 is between the first washer 94 and the riser 12.

Figure 6:
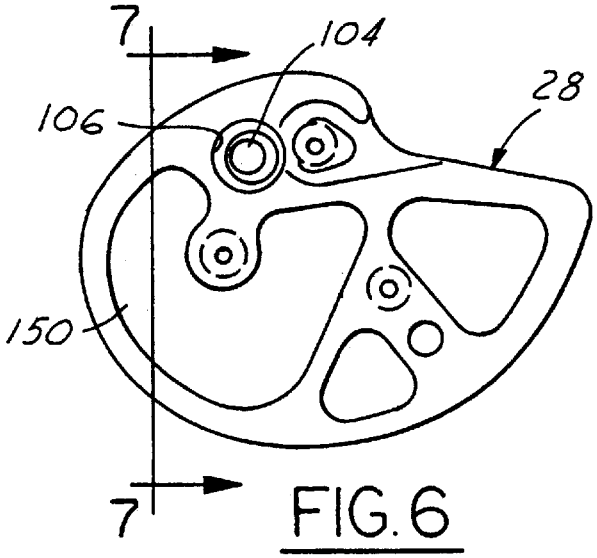
FIG. 6 is a side view of a cam.
Figure 7:
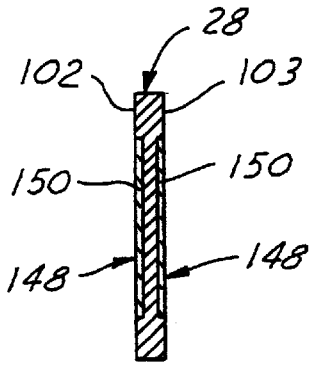
FIG. 7 is a cross-sectional view taken along 7—7 of FIG. 6.

The free ends 24, 26 of the limbs 20, 22 have the cam 28 and the idler wheel 30 connected thereto by axles 98, 100, respectively. As shown in FIGS. 6 and 7, the cam 28 has generally parallel opposed sides 102, 103 with a through bore 104 and a counterbore 106 adjacent each side 102, 103. Each bore 104 receives an axle 98, 100 and preferably, a bearing is received in each counterbore 106 to facilitate rotation of the cam 28 and the idler wheel 30 on the axles 98, 100, respectively.

To complete the assembly of the archery bow 10, the bow string 32 is trained around the cam 28 and the idler wheel 30 to a desired tension with the limbs 20, 22 flexing at least slightly in a preloaded position.

As shown in FIGS. 3–5, in accordance with the present invention to reduce or dampen noise and vibration in the bow 10, a first dampener 108 is disposed between the pocket body 34 and the riser 12. The first dampener 108 has a through hole 110 for receiving the pocket bolt 64 and a slot 112 for receiving the limb bolt 88. The first dampener 108 is preferably received in the channel 60 of the pocket body 34 to engage the pocket body 34 and the riser 12. This prevents the pocket body 34 from directly contacting the riser 12 to reduce noise and vibration from passing directly between the pocket body 34 and the riser 12. The first dampener 108 may be glued to the pocket body 34 and/or the riser 12, if desired. The first dampener 108 is preferably formed of a polymeric material and may be a thermoset, thermoplastic or elastomeric material such as a rubber, neoprene, Buna-N, santoprene, silicone, plastisol, open or closed cell foam and synthetic rubbers, but may also be a leather or felt type material.

In addition to or separately from the first dampener 108, to reduce or dampen noise and vibration in the bow 10, a second dampener 114 is disposed at least in part in the second recess 71 of the pocket body 34 between the end 40 of the pocket body 34 and the pocket bolt 64. The second dampener has opposed flat faces 116, 118, side walls 120, 122 and a thickness or height defined between the faces 116, 118. The height of the second dampener 114 is greater than the depth of the second recess 71 so that the second dampener 114 extends outwardly from the recess 71 above the upper surface 46 of base 44 to engage the limb 20 in assembly. The second dampener 114 has a slot 126 extending through the opposing faces 116, 118 through which the shank 92 of the limb bolt 88 extends in assembly of the bow 10. For increased surface area, the second dampener 114 may have a pair of legs 128 between which the pocket bolt 64 may be received. The side walls 120, 122 of the second dampener 114 each preferably have tabs 124 extending outwardly therefrom with each tab 124 to be received at least in part in a separate one of the holes 43 in the pocket body 34. The tabs 118 are preferably compressed in the holes 43 so that they are in direct, intimate engagement with the pocket body 34. While not wishing to be held to any particular theory, it is currently believed that the holes 43 and tabs 124 provide paths for vibration and noise to escape from the confinement of the pocket body 34 to further reduce noise and vibration in the bow 10. After assembly of the limb 20 to the riser 12, the second dampener 114 is compressed in height by between 0.5 and 90 percent, and preferably between 10 and 50 percent of its uncompressed height to fully and firmly engage the limb 20 and the pocket body 34 to reduce noise and vibration passing between the limb 20 and the riser 12. The second dampener 114 is preferably formed of an elastomeric material such as rubber, neoprene, Buna-N, santoprene, silicone, plastisol, open or closed cell foam and synthetic rubbers.

In addition to one or both of the first and second dampeners 108, 114, or without either of them, to reduce noise and vibration in the bow 10, a third dampener 132 is disposed between the limb 20 and pocket body 34 in the third recess 73. The third dampener 132 is shown here to be cylindrical, but can take on substantially any shape as desired for a particular application. The third dampener 132 has a height defined by its diameter which is greater than the depth of the third recess 73 so that the third dampener 132 extends at least slightly above the base 44 of the pocket body 34 and is engaged by the limb 20 in assembly. After assembly of the limb 20 to the riser 12, the third dampener 132 is compressed in height by between 0.5 and 90 percent, desirably between 10 and 50 percent, and preferably about 30 percent of its uncompressed height to fully engage the limb 20 and the pocket body 34. The third dampener 132 further reduces noise and vibration from passing between the limb 20 and the pocket body 34, absorbs bending stresses of the limb 20 and cushions the limb 20 from shock and vibration. The third dampener is preferably made of a compressible elastomeric material such as rubbers, neoprene, Buna-N, santoprene, silicone, plastisol, open or closed cell foams and synthetic rubbers.

As shown in FIG. 5, to reduce noise and vibration in the bow 10, either by itself or in combination with other dampers, a fourth dampener 134 is disposed between the pivot pins 72 and has a thickness or height such it engages both the pivot plate 78 and the pocket body 34. The fourth dampener 134 has a top surface 136 and a bottom surface 138 defining a height between them such that the bottom surface 138 engages the pocket body 34 and the top surface 136 engages the pivot plate 78. Preferably, the fourth dampener 134 is uniformly compressed in height by between 0.5 and 90 percent, desirably between 1 and 50 percent, and preferably about 30 percent of its uncompressed height after assembly of the limb 20 to the riser 12 so that it fully engages the pocket body 34 and the pivot plate 78 to reduce noise and vibration passing between the limb 20, the pivot plate 78, and the pocket body 34. The fourth dampener 134 is preferably made of a compressible elastomeric material such as rubber, neoprene, Buna-N, santoprene, silicone, plastisol, open or closed cell foams and synthetic rubbers.

As an alternative or in addition to the other dampeners, a fifth dampener 140 may be disposed between the pivot plate 78 and the limb 20. The fifth dampener 140 is preferably thin and flat and prevents direct contact between the pivot plate 78 and limb 20. After assembly of the limb 20 to the riser 12, the fifth dampener 140 is compressed in height by between 0.5 and 90 percent, desirably between 1 and 50 percent, and preferably about 30 percent of its uncompressed height after assembly of the limb 20 to the riser 12 so that the dampener 140 fully engages the limb 20 and the pivot plate 78 to reduce noise and vibration from passing between the limb 20 and the pivot plate 78. As another alternative, the pivot plate 78 may be coated with a polymeric material to eliminate metal to limb 20 contact at the pivot plate 78. The fifth dampener 140 is preferably made of a compressible elastomeric material such as rubbers, neoprene, Buna-N, santoprene, silicone, plastisol, open or closed cell foams and synthetic rubbers.

Figure 8:
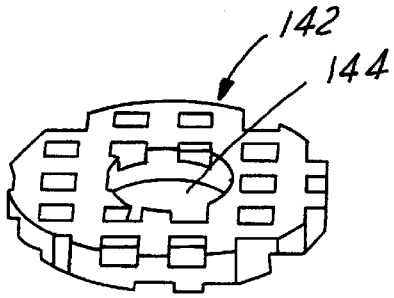
FIG. 8 is a perspective view of a waffle washer.

As shown in FIG. 8, to reduce noise and vibration, the bow preferably has a waffle dampener 142 disposed between the first washer 94 and the limb 20. The waffle dampener 142 is preferably annular with a through hole 144 to receive the limb bolt 88. The waffle dampener 142 is preferably a wave-type or other non-planar washer having undulations or other discontinuous surface form having spring or cushion characteristics and is compressed when the limb bolt 88 is tightened to fasten the limb 20 to the riser 12 so that it firmly engages the first washer 94 and the limb 20. The waffle dampener 142 may be formed from a spring grade steel but is desirably formed of a compressible polymeric material, preferably an elastomeric material such as rubber, neoprene, Buna-N, santoprene, silicone, plastisol, and synthetic rubbers, but may also be a leather or felt type material. A suitable waffle dampener is commercially available from McMaster-Carr.

As shown in FIG. 4, a sixth dampener 146 having a generally cylindrical shape with an opening 147 is preferably disposed around the limb bolt 88 generally between the limb 20 and the riser 12. The sixth dampener 146 is received in the slot 126 of the second dampener 114 (if incorporated), the slot 52 in the pocket body 34 and preferably the slot 112 in the first dampener 108 (if incorporated) to engage the riser 12. The sixth dampener 146 preferably comprises a coil spring having a spring rate generally in the range of 5–25 lbs/in, but can be any elastomeric material preferably having a cylindrical shape and a spring rate generally in the range of 5–25 lbs/in and having suitable dampening characteristics. The sixth dampener 146 has a height or length that is generally compressed in a range of 1–75 percent of its uncompressed height when the limb 20 is assembled to the riser 12 to ensure adequate engagement with the limb 20 and the riser 12 providing a force tending to separate the limb 20 from the riser 12 and to further reduce noise and vibration passing between the limb 20 and the riser 12.

Preferably, a seventh dampener 148 is carried by the cam 28 to reduce noise and vibration between the cam 28 and the limb 20. As shown in FIGS. 6 and 7, a recess 150 taking on substantially any shape and preferably in each side 102, 103 of the cam 28 is constructed to receive at least in part a separate seventh dampener 148. The seventh dampener 148 has a shape that corresponds to the shape of the recesses 150 in the opposing sides 102, 103 and covers generally a range of 1–90 percent of the surface area of the cam 28. The seventh dampener 148 is attached to the cam 28 in the recess 150 preferably using an adhesive. Preferably, the seventh dampener 148 is made of an elastomeric material such as rubber, neoprene, Buna-N, santoprene, silicone, plastisol, synthetic rubbers, open or closed cell foams or a leather or felt type material.

Figure 9:
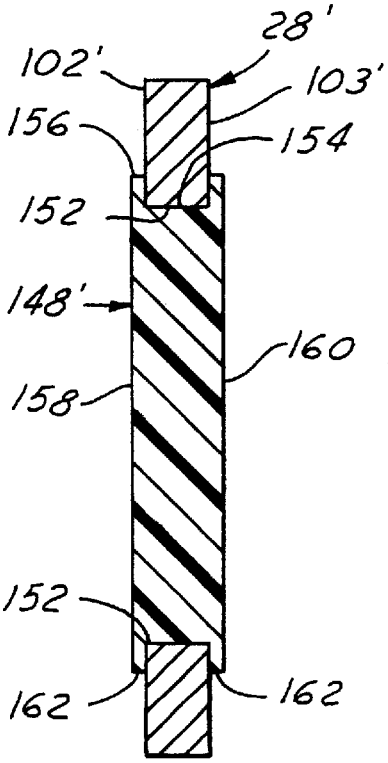
FIG. 9 is a cross-sectional view of a first alternative embodiment of the cam.

Alternatively, as shown in FIG. 9, a modified cam 28' has an opening 152 passing through the opposing sides 102', 103' of the cam 28'. A modified seventh dampener 148' has a groove 154 at least in part in its periphery 156 and between its opposed sides 158, 160 defining lips 162 on either side of the groove 154. The dampener 148' is inserted into the opening 152 so that the groove 154 is disposed in the opening 152 with each lip 162 overlying a separate side 102', 103' of the cam 28'.

It will be appreciated by those skilled in the art that modifications and variations of this invention may be made without departing from the spirit and scope of the invention. The dampeners described above may be used in conjunction with one another, or may be used separately as desired. Similarly, one or more dampeners may be attached to or carried by the idler wheel 30 as described with reference to the cams 28, 28'. Further, as mentioned previously, identical dampeners are preferably used for each limb 20, 22 and pocket body 34, 36. The combination of dampeners generally in the pocket area may cover up to 90 percent of the effective surface area of each pocket body 34, 36. The dampeners other than the sixth dampener 146 have a durometer generally in the range of 15–110 Shore A, and preferably in the range of 50–80 Shore A, and have a thickness generally in the range of 0.015–1 inch. In addition to the materials listed for each dampener, it is to be understood that any elastomers, polymers, copolymers, PVC's, flouropolymers, air in compressed sealed chambers, springs and the like can be used to form the dampeners. It is also to be understood that glues in the form of silicone, polyethylene, epoxies and the like can be used to fix the dampeners in there respective positions throughout assembly.

What is claimed is:

1. An archery bow, comprising:

a riser having spaced apart ends;

a pair of limbs each having a first end attached to a separate one of the ends of the riser and a free end spaced from the riser;

a dampener received between the riser and the first end of each limb to reduce vibration of the bow in use; and the dampener has a pair of opposed faces defining a height of the dampener between them and in assembly of the limb to the riser the dampener is compressed in height between 10% to 50% of its height before compression.

2. An archery bow as in claim 1 wherein the dampener is formed of an elastomeric material.

3. An archery bow, comprising:

a riser having spaced apart ends;

a pair of limbs each having a first end attached to a separate one of the ends of the riser and a free end spaced from the riser;

a dampener received between the riser and the first end of each limb to reduce vibration of the bow in use; and a limb bolt having a shank for connecting the first end of the limb to the riser and the dampener has a slot through which the shank of the limb bolt extends.

4. An archery bow as in claim 1 which also comprises a pocket body connected to the riser and adapted to receive the first end of the limb with the dampener disposed between the pocket body and the limb so that it is engaged by both the limb and the pocket body.

5. An archery bow as in claim 4 wherein the pocket body has a recess having a depth and the dampener is disposed at least in part in the recess, the dampener having a height greater than the depth of the recess so that the dampener extends outwardly from the recess and is engaged by the limb when the limb is received the pocket body.

6. An archery bow as defined in claim 3 which also comprises:

a cam carried by the free end of the limb; and a cam dampener carried by the cam to reduce noise and vibration of the bow in use.

7. An archery bow as in claim 6 wherein the cam has a recess formed therein with the cam dampener disposed at least in part in the recess.

8. An archery bow as in claim 7 wherein the cam dampener is attached to the cam by an adhesive.

9. An archery bow as in claim 6 wherein the cam has an opening passing therethrough with the cam dampener received at least in part in the opening.

10. An archery bow as in claim 9 wherein the cam dampener has a periphery with a groove at least in part in the periphery so that the opening of the cam receives and extends into the groove of the cam dampener to mount the cam dampener on the cam.

11. An archery bow, comprising:

a riser having spaced apart ends;

a pair of limbs each having a first end attached to a separate one of the ends of the riser and a free end spaced from the riser;

a dampener received between the riser and the first end of each limb to reduce vibration of the bow in use;

a pocket body connected to the riser and adapted to receive the first end of the limb with the dampener disposed between the pocket body and the limb so that it is engaged by both the limb and the pocket body; and a pocket bolt attaching the pocket body to the riser and wherein the dampener has a space through which the pocket bolt is received.

12. An archery bow as in claim 11 wherein the pocket body has a first end and the dampener is positioned generally between the first end and the pocket bolt.

13. An archery bow, comprising:

a riser having spaced apart ends;

a pair of limbs each having a first end attached to a separate one of the ends of the riser and a free end spaced from the riser;

a dampener received between the riser and the first end of each limb to reduce vibration of the bow in use;

a pocket body connected to the riser and adapted to receive the first end of the limb with the dampener disposed between the pocket body and the limb so that it is engaged by both the limb and the pocket body; and the pocket body has holes therethrough with a portion of the dampener received in each hole.

14. An archery bow as in claim 13 wherein the dampener has tabs extending therefrom and received in the holes.

15. An archery bow, comprising:

a riser having spaced apart ends;

a pair of limbs each having a first end attached to a separate one of the ends of the riser and a free end spaced from the riser;

a dampener received between the riser and the first end of each limb to reduce vibration of the bow in use; and a pocket body connected to the riser and adapted to receive the first end of the limb with the dampener disposed between the pocket body and the riser so that it is engaged by both the pocket body and the riser.

16. An archery bow as in claim 15 which also comprises a limb bolt having a shank for attaching the first end of the limb to the riser wherein the dampener has a slot through which the shank of the limb bolt extends.

17. An archery bow as in claim 15 which also comprises a pocket bolt having a shank for attaching the pocket body to the riser and wherein the dampener has a through hole through which the pocket bolt is received.

18. An archery bow as in claim 15 wherein the pocket body has a channel in which the end of the riser is received, and the dampener is disposed in the channel.

19. An archery bow, comprising:

a riser having spaced apart ends;

a pair of limbs each having a first end attached to a separate one of the ends of the riser and a free end spaced from the riser;

a dampener received between the riser and the first end of each limb to reduce vibration of the bow in use; and a limb bolt having a shank connecting the first end of the limb to the riser and wherein the dampener is generally cylindrical and has an opening through which the shank of the limb bolt is received.

20. An archery bow as in claim 19 wherein the dampener comprises a coil spring.

21. An archery bow as in claim 19 wherein the dampener is formed of an elastomeric material.

22. An archery bow as in claim 19 wherein the dampener is compressible, has an uncompressed length before assembly of the archery bow and is compressed between 1%-75% of its uncompressed length when the limb is attached to the riser.

23. An archery bow as in claim 19 wherein the dampener has a spring rate in the range of 5–25 lbs/in.

24. An archery bow, comprising:

a riser having spaced apart ends;

a pair of limbs each having a first end attached to a separate one of the ends of the riser and a free end spaced from the riser;

a dampener received between the riser and the first end of each limb to reduce vibration of the bow in use; and pivot pins disposed between the limb and the riser and the dampener is disposed between the pivot pins.

25. An archery bow as in claim 24 which also comprises a pocket body disposed between the limb and the riser, a pivot plate disposed between the pocket body and the limb and wherein the pivot pins are disposed between the pocket body and the pivot plate such that the dampener is disposed between and in engagement with the pocket body and the pivot plate.

26. An archery bow, comprising:

a riser having spaced apart ends;

a pair of limbs each having a first end attached to a separate one of the ends of the riser and a free end spaced from the riser;

a dampener received between the riser and the first end of each limb to reduce vibration of the bow in use; and a pivot plate disposed between the limb and the riser with the dampener disposed between the pivot plate and the limb.

27. An archery bow comprising:

a riser having an end with a threaded hole in the end;

a limb bolt having a head and a threaded shank received at least in part in the threaded hole of the riser;

a limb having a first end attached to the end of the riser by the limb bolt with the limb between the head of the limb bolt and the riser; and a resilient dampener disposed between the head of the limb bolt and the riser and compressed at least 10% of its uncompressed height to reduce vibration and noise of the bow in use.

28. An archery bow as in claim 27 wherein the dampener has a through hole to receive the shank of the limb bolt.

29. An archery bow as in claim 27 wherein the dampener is formed of an elastomeric material having a durometer in the range of 50–80 Shore A.

30. An archery bow as in claim 27 wherein the dampener is a waffle washer.

* * * * *